US007079082B2

(12) United States Patent
Iskander et al.

(10) Patent No.: US 7,079,082 B2
(45) Date of Patent: Jul. 18, 2006

(54) COPLANAR WAVEGUIDE CONTINUOUS TRANSVERSE STUB (CPW-CTS) ANTENNA FOR WIRELESS COMMUNICATIONS

(75) Inventors: Magdy F. Iskander, Honolulu, HI (US); Wayne C. Kim, Mililani, HI (US); Jodie M. Bell, Honolulu, HI (US)

(73) Assignee: University of Hawaii, Honolulu, HI (US)

( * ) Notice: Subject to any disclaimer, the term of this patent is extended or adjusted under 35 U.S.C. 154(b) by 0 days.

(21) Appl. No.: 11/087,116

(22) Filed: Mar. 21, 2005

(65) Prior Publication Data

US 2005/0219136 A1 Oct. 6, 2005

Related U.S. Application Data

(60) Provisional application No. 60/558,592, filed on Mar. 31, 2004.

(51) Int. Cl.
*H01Q 13/00* (2006.01)
*H01Q 3/00* (2006.01)

(52) U.S. Cl. ..... 343/772; 343/762

(58) Field of Classification Search ..... 343/762, 343/772, 785, 884, 911 R, 753, 754
See application file for complete search history.

(56) References Cited

U.S. PATENT DOCUMENTS 5,905,472 A * 5/1999 Wolfson et al. ..... 343/772
6,157,347 A * 12/2000 Robertson ..... 343/772
6,421,021 B1 * 7/2002 Rupp et al. ..... 343/753
6,999,040 B1 * 2/2006 Robertson et al. ..... 343/772

* cited by examiner

*Primary Examiner*—Tuyet Vo
*Assistant Examiner*—Minh Dieu A
(74) *Attorney, Agent, or Firm*—Leighton K. Chong; Godbey Griffiths Reiss & Chong

(57) ABSTRACT

An improved continuous transverse stub (CTS) antenna has coplanar waveguide (CPW) feed elements spaced apart aligned in parallel and mounted perpendicular to a planar substrate base made of a low dielectric material. A continuous transverse stub extends perpendicularly through a clearance gap in the CPW feed elements on the ground plane of the substrate base. The antenna is fed with a simple coplanar waveguide transmission line formed by the parallel CPW elements. The antenna employs the coplanar waveguide with CTS technology, preferably in a planar microstrip configuration, to produce a broadside radiation pattern with a maximum in the +z direction, perpendicular to the plane of the antenna. The CPW-CTS antenna offers the advantages of a broadside radiation pattern, low input impedance, high radiation efficiency, low fabrication cost, use of simple coaxial or microstrip transmission line feed, and simple integration with microstrip circuitry in a transceiver front-end. The CPW-CTS antenna may be integrated in a single frequency band or in multiband arrays and could provide radiation beam steering capability when integrated with a substrate of tunable dielectric material such as BSTO.

14 Claims, 6 Drawing Sheets

FIG. 3(a) E-Plane Radiation Pattern
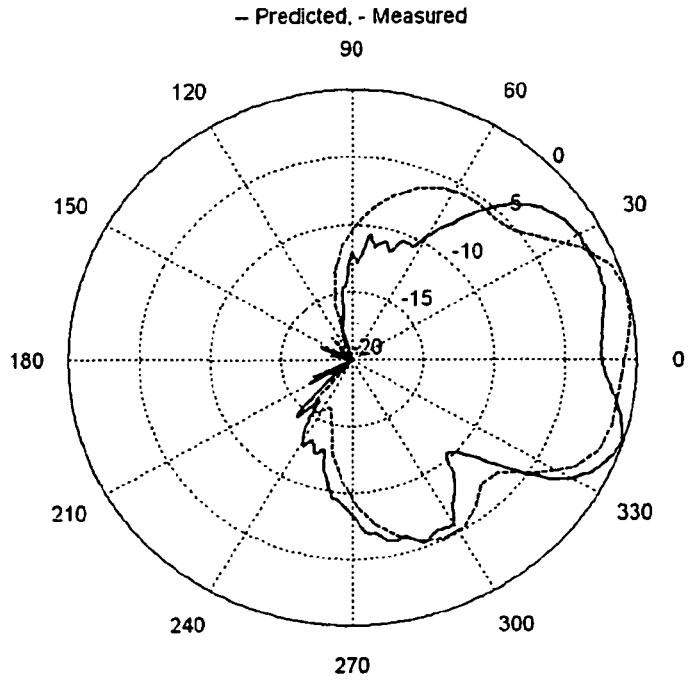
FIG. 3(b) H-Plane Radiation Pattern
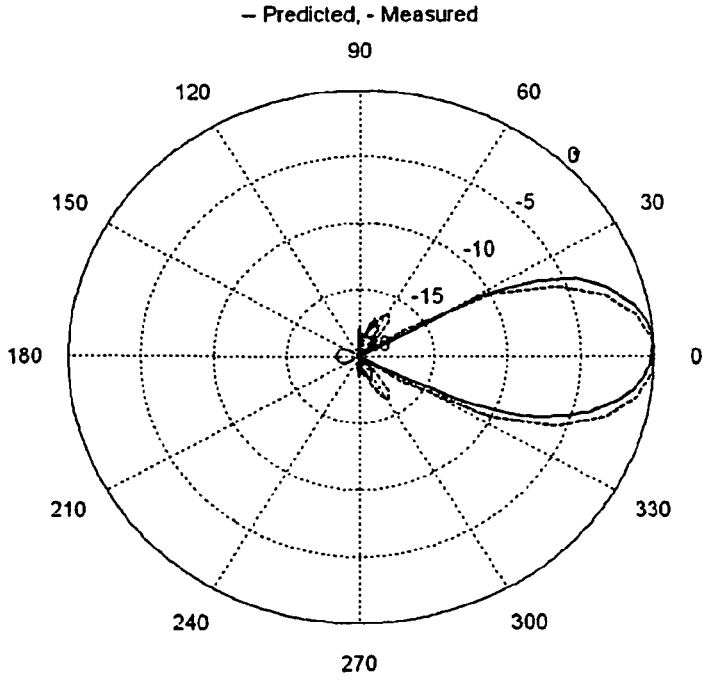

COPLANAR WAVEGUIDE CONTINUOUS TRANSVERSE STUB (CPW-CTS) ANTENNA FOR WIRELESS COMMUNICATIONS

This U.S. patent application claims the priority of U.S. Provisional Application No. 60/558,592 filed on Mar. 31, 2004, entitled "Coplanar Continuous Transverse Stub (CTS) Antennas", by the same inventors.

TECHNICAL FIELD

This invention generally relates to continuous transverse stub (CTS) antennas, and more particularly, to an improved design that is mountable on a flat surface while being fed using a simple and low cost coaxial, microstrip, or coplanar transmission line and has multi-band capabilities and also low cost beam steering using ferroelectric technology.

BACKGROUND OF INVENTION

The planar continuous transverse stub (CTS) antenna and antenna array were originally invented and patented by Raytheon in the early 1990's, for example, in U.S. Pat. No. 5,266,961, by W. W. Milroy, issued 29 Aug. 1991, entitled "Continuous transverse stub (CTS) element devices and methods of making same". Benefits of the CTS antenna include compact size, lightweight, low cost, increased directive gain with increased radiating elements, and high efficiencies. The CTS antenna finds applications in the areas of mobile wireless and satellite communications and various military radar systems operating in the 500 MHz to 90 GHz frequency band.

A new coaxial version of the CTS technology with omni-directional radiation pattern is described in M. F. Iskander, Z. Zhang, Z. Yun, and R. Isom, "Coaxial Continuous Transverse Stub (CTS) Array," *IEEE Microwave and Wireless Components Letters*, vol. 11, no. 12, pp. 489–491, 2001, and in U.S. Pat. No. 6,201,509, of inventors in common herewith. A coaxial version of the CTS technology for multiband operation was reported in R. Isom, M. F. Iskander, Z. Yun, Z. Zhang, "Design and Development of Multiband Coaxial Continuous Transverse Stub (CTS) Antenna Arrays," *IEEE Trans. Antennas and Prop.*, vol. 52, no. 8, August 2004. In particular, it was demonstrated that multiband performance at the 4.2 and 19.4 GHz frequency band with equivalent radiated power (~98%) and good impedance match is possible to achieve using this technology.

However, it is deemed desirable to improve the CTS antenna to be flat-mounted and have a broadside radiation pattern, low fabrication cost, simple coaxial, coplanar, or microstrip transmission line feed, and simple integration with microstrip circuitry in a transceiver front-end. With the flat implementation of the design, it is possible to provide beam steering capabilities through the integration of the antenna structure with a tunable dielectric substrate material as will be described in more details herein.

SUMMARY OF INVENTION

In accordance with the present invention, an improved continuous transverse stub (CTS) antenna has coplanar waveguide (CPW) feed elements spaced apart aligned in parallel with each other (x-directed) and mounted perpendicular to a planar substrate base made of a material of low dielectric constant. The CPW feed elements have associated with them quasi TEM modes which are interrupted by the presence of a continuous transverse stub on the ground plane of the substrate base. The presence of the purely reactive transverse stub elements couples a longitudinal, z-directed displacement current across the parallel plate transmission line and coplanar waveguide interface. This induced current excites z-directed EM waves where the electric field is linearly polarized in the transverse direction (y-directed) to the stub elements. The improved CPW-CTS antenna operates as a traveling-wave-fed antenna.

The transverse stub is preferably formed by a central portion of width (CW1) made of a conductive coating disposed on the ground plane surface with gap portions of width (CW) on each side thereof, providing a total stub gap width (GW). The CPW feed elements are preferably a pair of parallel plates spaced apart by a first length (L1) and having a width (W1) and height (H1) above the ground plane. The transverse stub extends perpendicularly through a clearance gap of height (H2) in the transverse direction across the ground plane. The clearance gap height (H2) is used to adjust the coupling capacitance to compensate the inductance of the purely reactive stub elements. The antenna is fed with a simple coplanar waveguide transmission line formed by the parallel CPW elements. The feed point (L2) is positioned away from the edge of the stubs to maintain a good impedance match. L2 is carefully chosen to obtain the desired radiation pattern as a result of the axis EE of the feed line being oriented in line with the E-Plane radiation pattern. The substrate height (SH) is chosen for structural integrity and for improving the directive gain.

In a preferred embodiment, the signal conductor width (CW), total stub gap width (GW), and dielectric constant ($\in_r$) were chosen to provide 50 ohms feed impedance. The length (L1), width (W1), and height (H1) of the parallel plates were selected to be approximately a half wavelength, one wavelength, and one-third wavelength, respectively. The values of CW and CW1 were carefully chosen and after extensive simulations to produce increased radiated power and at the same time maintain good impedance match. The width (W2) of the opposite outward portions from the plates is selected to reduce undesired back lobes, most notably in the H-Plane radiation measurements.

The CPW-CTS antenna of the present invention employs the coplanar waveguide with CTS technology, preferably in a planar microstrip configuration, to produce a broadside radiation pattern with a maximum in the +z direction, perpendicular to the plane of the antenna. The coplanar CTS offers the advantages over previous designs of a broadside radiation pattern, low input impedance, high radiated power, low fabrication cost, use of simple coaxial or microstrip transmission line feed, and simple integration with microstrip circuitry in a transceiver front-end.

Other objects, features, and advantages of the present invention will be explained in the following detailed description having reference to the appended drawings.

BRIEF DESCRIPTION OF DRAWINGS

FIG. 3(*a*) is a chart showing measured to predicted values for E-Plane radiation pattern, and FIG. 3(*b*) is a chart showing measured to predicted values for H-Plane radiation pattern.

DETAILED DESCRIPTION OF INVENTION

The present invention provides an improvement upon previously known CTS technology, for example, as described in U.S. Pat. No. 6,201,509, to a named inventor in common herewith, which is incorporated by reference in its entirety herein. The CTS antenna employs a continuous transverse stub to form reactive or radiating elements for microwave, millimeter-wave, and quasi-optical filters and antennas. Purely reactive elements are formed by leaving a conductive coating on the surface of the stub elements to form radiating elements. The conductive material may be a ferroelectric material. The stub may be formed with individual stub elements separated from each other by air gaps or an appropriate material.

Figure 1A:
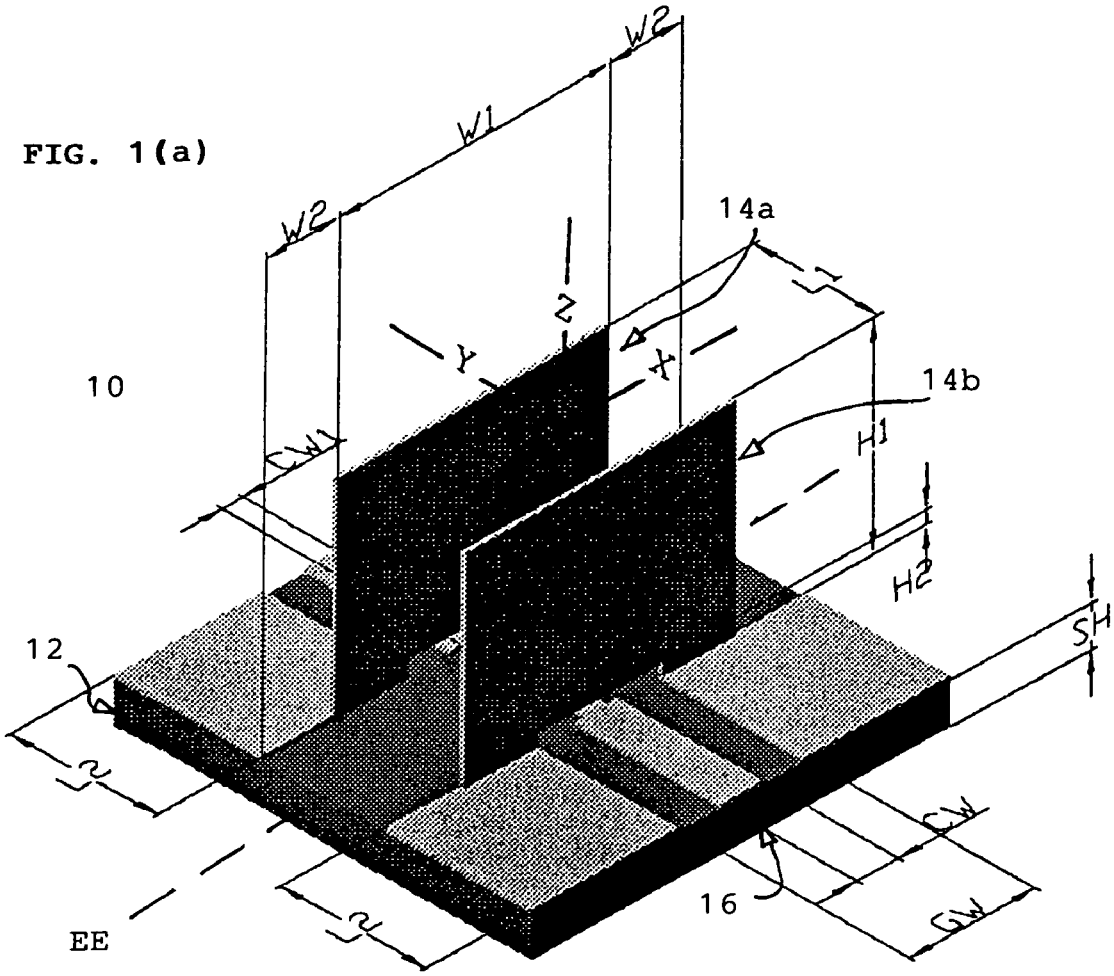
FIG. 1(*a*) shows a schematic of a coplanar waveguide continuous transverse stub (CPW-CTS) antenna, and FIG. 1(*b*) shows a fabricated prototype example of the CPW-CTS antenna in accordance with the present invention.
Figure 1B:
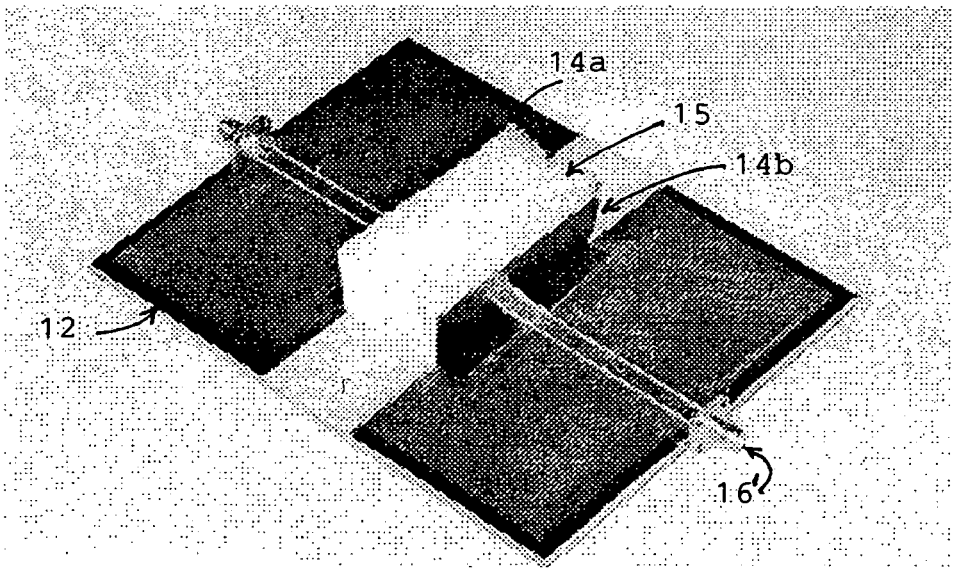

Referring to FIG. 1(*a*), a schematic diagram illustrates a co-planar waveguide, continuous transverse stub (CPW-CTS) antenna 10 in accordance with the present invention. The CPW-CTS antenna 10 has a planar substrate base 12 made of a material with a low dielectric constant, and a pair of coplanar waveguide (CPW) feed elements 14*a*, 14*b* extending longitudinally in the X-direction aligned in parallel with each other and mounted perpendicular to the plane of the substrate base 12. The CPW feed elements 14*a*, 14*b* have associated with them quasi TEM modes which are interrupted by the presence of a continuous transverse stub element 16 formed on the ground plane. The presence of the purely reactive transverse stub elements couples a longitudinal, z-directed displacement current across the parallel plate transmission line and coplanar waveguide interface. This induced current excites z-directed EM waves where the electric field is linearly polarized in the transverse direction (Y-direction) to the stub elements, so that the CPW-CTS antenna operates as a traveling-wave-fed antenna.

The coupling values from the CPW elements to the stub radiating elements are primarily dependent on the following dimensional parameters:

- Height (H1) of the top of the CPW feed elements above the ground plane
- Gap clearance height (H2) of the CPW feed elements over the ground plane
- Width (W1) of CPW elements across the ground plane
- Width (W2) on each side externally from the width of CPW elements
- Distance (L1) between parallel CPW elements
- Distance (L2) on each side externally from the CPW elements
- Central portion width (CW1) between stub radiating elements
- Signal conductor width (CW) of stub radiating elements
- Total stub gap width (GW) of central portion and stub radiating elements
- Dielectric constant ($\in_r$) of conductive material for transverse stub
- Substrate height (SH)

The transverse stub is preferably formed by a central portion of width (CW1) made of a conductive coating disposed on the ground plane surface with gap portions of width (CW) on each side thereof, providing a total stub gap width (GW). The CPW feed elements are preferably a pair of parallel plates spaced apart by a first length (L1) and having a width (W1) and height (H1) above the ground plane. The transverse stub extends perpendicularly through a clearance gap of height (H2) in the transverse direction across the ground plane. The clearance gap height (H2) is used to adjust the coupling capacitance to compensate the inductance of the purely reactive stub elements. The antenna is fed with a simple coplanar waveguide transmission line formed by the parallel CPW elements. The feed point (L2) is positioned away from the edge of the stubs to maintain a good impedance match. L2 is carefully chosen to obtain the desired radiation pattern as a result of the axis EE of the feed line being oriented in line with the E-Plane radiation pattern. The substrate height (SH) is chosen for structural integrity and for improving the directive gain.

In a preferred embodiment, the signal conductor width (CW), total stub gap width (GW), and dielectric constant ($\in_r$) were chosen to provide 50 ohms feed impedance. The length (L1), width (W1), and height (H1) of the parallel plates were selected to be approximately a half wavelength, one wavelength, and one-third wavelength, respectively. The values of CW and CW1 were carefully chosen and after extensive simulations to produce increased radiated power and at the same time maintain good impedance match. The width (W2) of the opposite outward portions from the plates is selected to reduce undesired back lobes, most notably in the H-Plane radiation measurements.

For simulation testing of the operating characteristics of the CPW-CTS antenna, a WIPL-D electromagnetic modeling program was used. It is a full 3-D electromagnetic simulation based on the method of moments, e.g., as described by Kolundzija, B., Ognjanovic, J. and Sarkar, T., *WIPL-D: Electromagnetic Modeling of Composite Wire and Plates Structures—Software and User's Manual*, Artech House, Boston, 2000. An antenna operating at 5.3 GHz was designed and desired features include low input impedance, high radiated power, and a broadside radiation pattern. The design dimensions obtained after extensive simulations were as follows:

H1=18.2 mm
H2=1.5 mm
W1=54.5 mm
W2=28.3 mm
L1=27.3 mm
L2=54.5 mm
CW=CW1=4.7 mm
GW=5.97 mm
Dielectric constant $\in_r$=2.94 (RT/Duroid 6002)
SH=3.01 mm.

A prototype of the CPW-CTS antenna was fabricated using the above simulation-designed parameters, as shown in FIG. 1(*b*). A coaxial tube type of transverse stub 16' (as described in U.S. Pat. No. 6,201,509) was used in this prototype. In the figure, a styrofoam spacer 14 is shown inserted over the radiating stub 16' between the CPW elements 14*a*, 14*b* to accurately maintain the radiating dimensions of the design distance between elements.

Figure 2A:
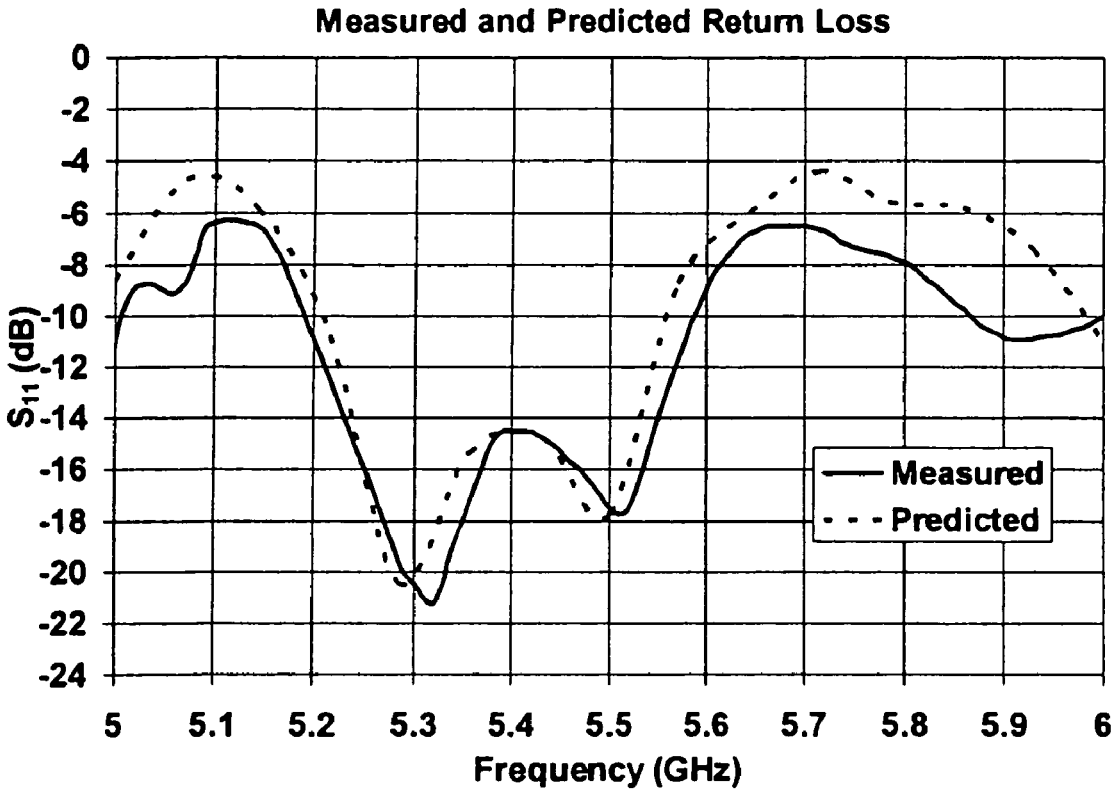
FIG. 2(*a*) is a chart showing measured to predicted values for return loss, and FIG. 2(*b*) is a chart showing measured to predicted values for insertion loss.
Figure 2B:
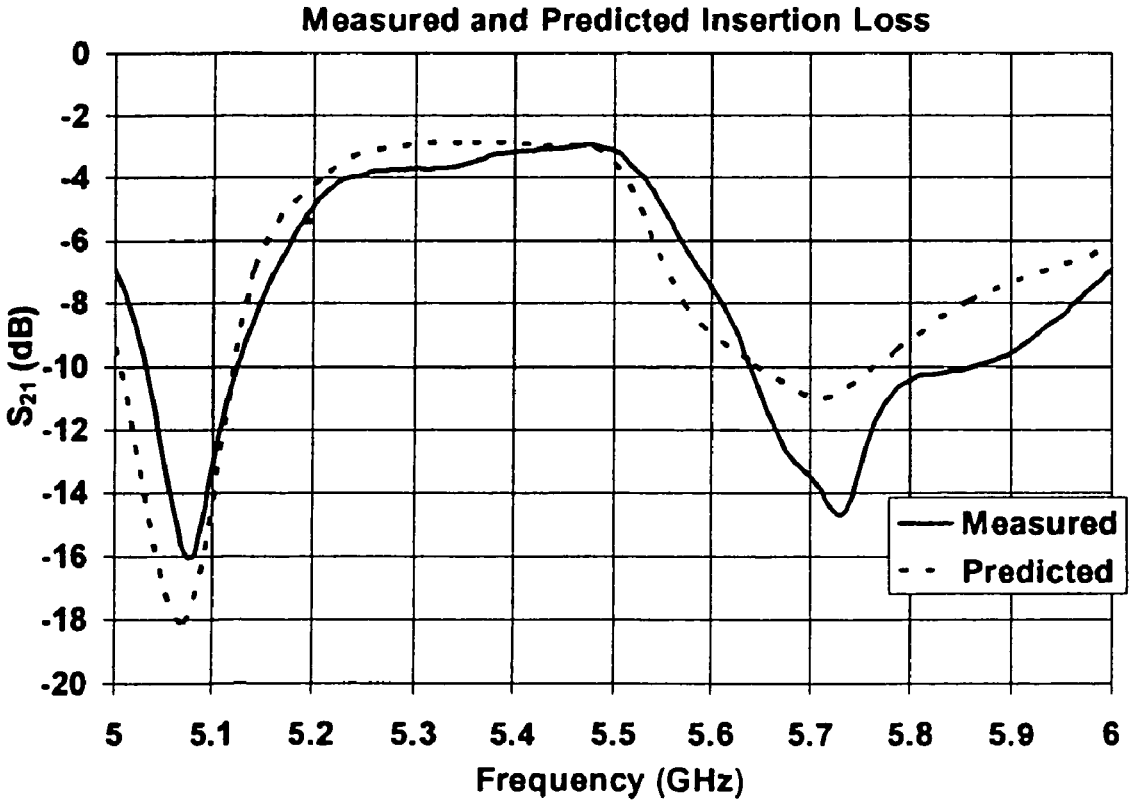

Referring to FIGS. 2(*a*) and 2(*b*), the charts of frequency (GHz) to signal (dB) show good agreement between the measured and the predicted (simulated) return and insertion losses, respectively. As can be seen, $S_{11}$ was better than −10 dB between 5.2 and 5.6 GHz with a radiated power ratio greater than 40%, where the radiated power ratio is given by:

$$Pwr_{rad} \approx \frac{Pwr_{rad} - Pwr_{refl} - Pwr_{trans}}{Pwr_{tot}} * 100\% \quad (1)$$

The term transferred power is used to account for the amount of power received at the end of the antenna and after the radiating stub.

FIGS. 3(*a*) and 3(*b*) shows good agreement between the measured and the predicted E-Plane and H-Plane radiation patterns at 5.3 GHz, respectively. The measured E-Plane beam peak was −18° and the measured 3-dB beam width was 74.8°. The maximum back lobe was −14 dB from the maximum beam peak. The maximum back lobe of the measured H-Plane was −17 dB down from the maximum beam peak. The good agreement between predicted and measured results validates the predictability of the performance of this new antenna design.

Other design selections and modifications may be made to optimize the dimensions, characteristics, and/or performance of the CPW-CTS antenna. For example, the square stubs of the CPW-CTS antenna shown in FIG. 1(*a*) may be replaced with semi-circular stubs in order to form a low profile antenna with radial dimensions equivalent to the height (H1). Simulated results of such a configuration showed identical results.

Example of CPW-CTS Antenna Array

Figure 4:
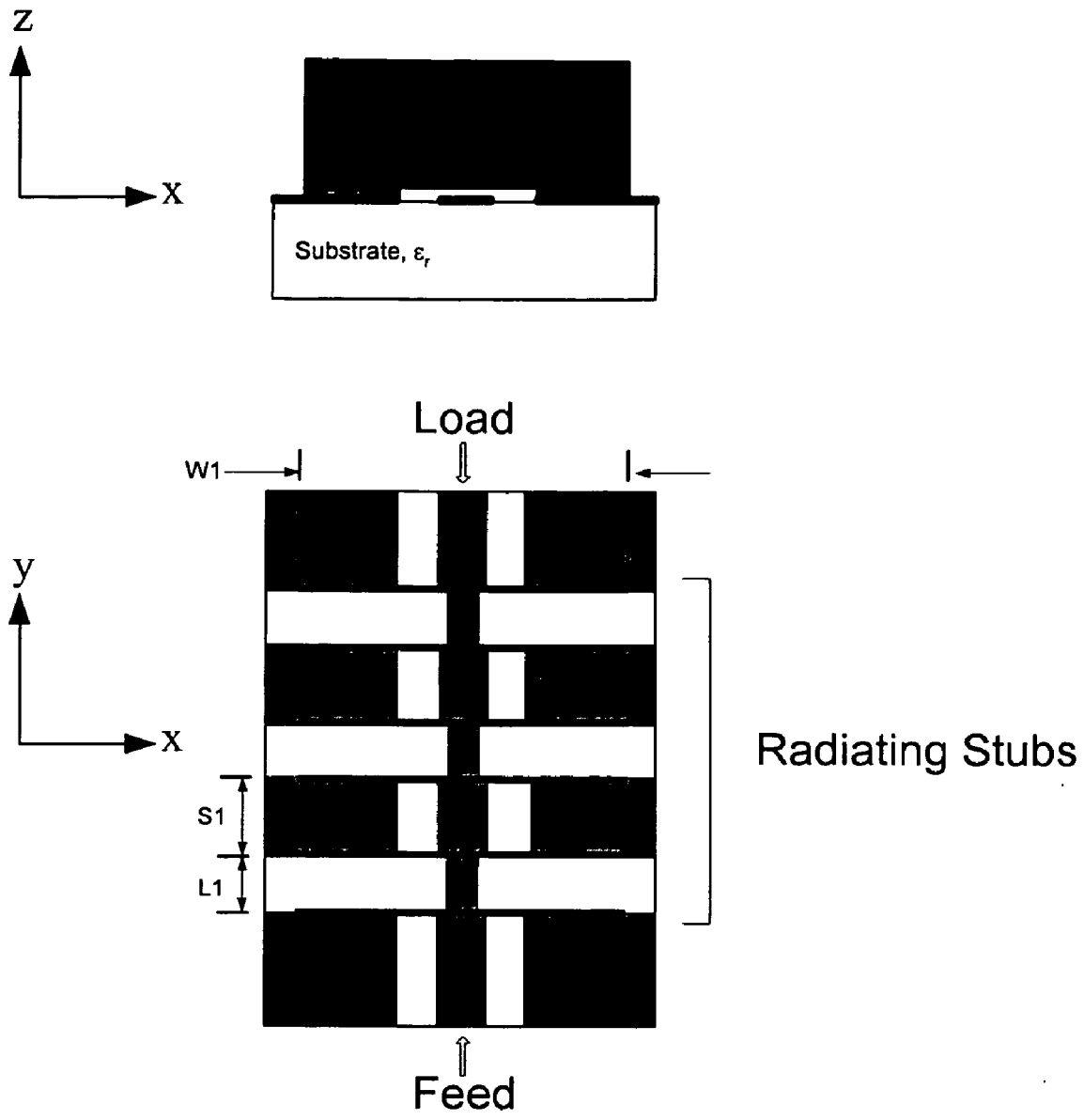
FIG. 4 shows an example of a coplanar waveguide continuous transverse stub array.

The invented continuous transverse stub design can be integrated in an array arrangement as shown in FIG. 4 to increase the gain and narrow the beam width of the overall antenna. Increased gain may be achieved by increasing the amount of stub elements. Accomplishing this using a single feed in the antenna arrangements provides a significant advantage in simplicity of implementation and low cost of fabrication. The coupling from the microstrip to the radiating elements is primarily dependent on the parallel plate spacing (L1) and width (W1). The element to element spacing (S1) controls the amount of mutual coupling between each element. Element spacings are chosen to be approximately equal to an integral number of wavelengths (typically one) within the coplanar waveguide region. With increased elements, appropriate variation of the plate spacing (L1) and element to element spacings (S1) are required to achieve the desired radiated power based on the series nature of the array.

Example of CPW-CTS Multiband Array

Figure 5:
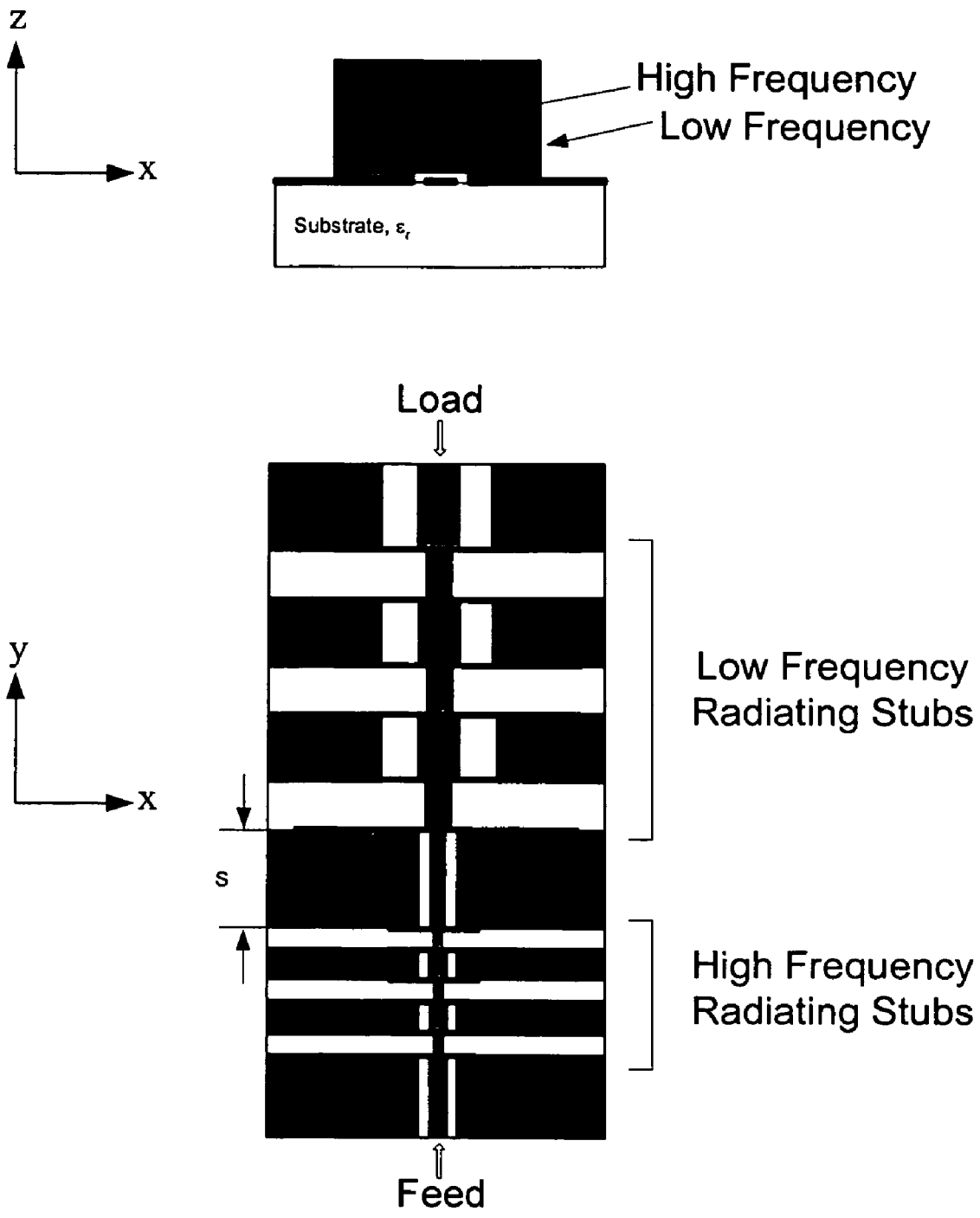
FIG. 5 shows an example of a multiband coplanar waveguide continuous transverse stub.

A multiband planar array for microwave and millimeter wave applications may be constructed through appropriate selection of inter-element spacings and continuous transverse stub parameters. The selected frequency bands may be well separated due to the dispersionless nature of the air filled parallel plate transmission line structure and the frequency independent orthogonality of the coplanar waveguide modes. A six element multiband (two bands in this case with three elements array in each band) coplanar waveguide continuous transverse stub is shown in FIG. 5. Periodically-spaced continuous transverse stub elements designed to operate at the appropriate frequency bands are arranged with the high frequency radiators closest to the feed and low frequency radiators farthest from the feed. In this case the first three elements radiate at high frequency and last three radiate at lower frequencies. Typical planar array developments require the design of separate subarrays for each frequency band then merged to form the multiband array. Appropriate multiband performance is achieved with proper selection of the sub array spacing (S). Based on the wavelength dependence of the parallel plate elements and inter-element spacings, the subarray designed for higher frequencies will be relatively smaller compared with those for lower frequencies. Extended frequency bands may be realized using the aforementioned techniques.

Example of CPW-CTS Array With Beam Steering Capabilities

Figure 6:
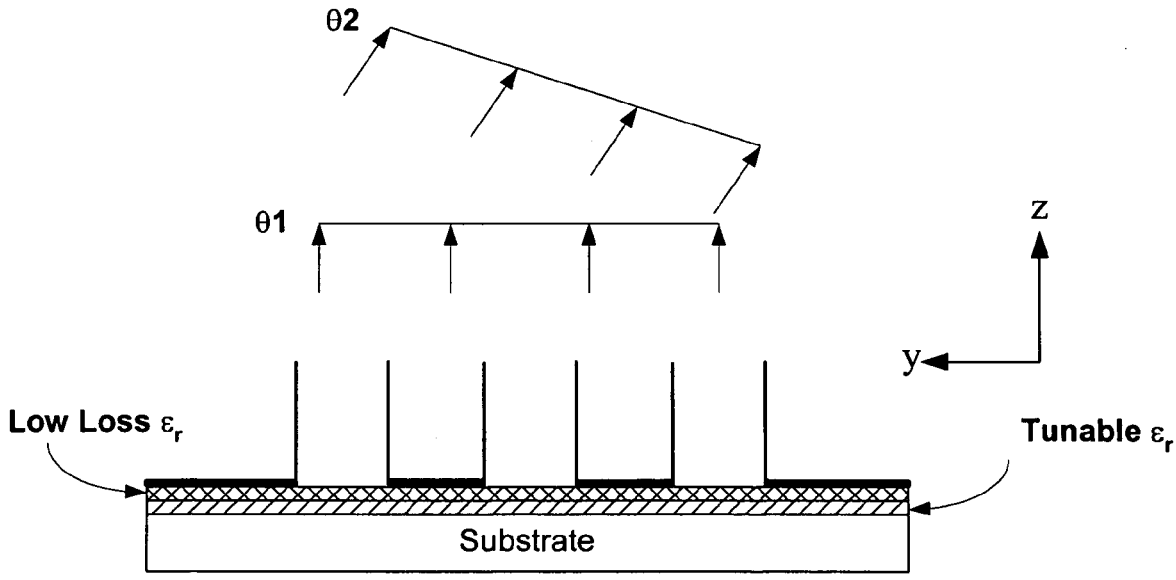
FIG. 6 shows an example of a CPW-CTS array with beam steering capabilities.

The coplanar implementation of the continuous transverse stub technology also lends itself to effective and low cost designs of antenna arrays with beam steering capabilities. As shown in FIG. 6, by including a layer of tunable dielectric materials such as Barium Strontium Oxide (BSTO), and providing the necessary biasing arrangement required to provide proper modulation of the dielectric constant, the radiation pattern of the array may be steered along the axis of the array. To help with the reduction of the insertion loss of the developed devices, a multilayer arrangement including a low loss dielectric between the conductors and the Barium Strontium Oxide layer (as shown in FIG. 6) may be implemented. For more details on BSTO technology for CTS antenna arrays, see W. Kim, M. Iskander, and C. Tanaka, "High-performance low-cost phase-shifter design based on ferroelectric materials technology", *IEE Electronic Letters,* 2004, vol. 40, no. 21, pp. 1345–1347.

The coplanar waveguide continuous transverse stub array has many performance, reproducibility, and application advantages over conventional slotted waveguide array, printed patch array, and reflector and lens antenna approaches in applications for which planar arrays have been inappropriate due to traditional bandwidth and/or cost limitations. Producibility advantages include considerable insensitivity to dimensional and limited material properties variations and simplified fabrication and processing procedures and ease of integration in the transceiver systems. This all leads to the low cost advantage of this technology. Making antenna components with BSTO ceramics with reliable dimensions in cylindrical geometries is currently achievable, and the planar structure of this CPW-CTS antenna configuration will facilitate this with ease.

In summary, a new coplanar waveguide CTS (CPW-CTS) antenna has been described. Advantages of this new design include low cost, low profile, light weight, and a very simple planar microstrip feed configuration. The design was validated by comparing measured results of a designed prototype against simulation results for a single element CPW-CTS design in the 5.2 to 5.6 GHz band. Both S-parameters and radiation pattern results were examined and good agreement between the experimental and simulation data were illustrated. Specifically, the designed one-element antenna exhibited a well-formed broadside main beam at the 5.3 GHz and good 50 ohms impedance match (−10 dB) from 5.2 to 5.5 GHz.

For further development, the coplanar waveguide CTS antenna design can be loaded with multiple elements to form a series array for improved directive gain and narrow beam widths. A multiple element array could also be formed with frequency selective sections to enable multiband operation. The planar design could be integrated with tunable ferroelectric materials to introduce multiband, electronic beam scanning capabilities, for example, as discussed in M. Iskander, Z. Zhang, Z. Yun, R. Isom, M. Hawkins, R. Enrick, B. Bosco, J. Synowczynski, and B. Gersten, "New phase shifters and phased antenna array designs based on ferroelectric materials and CTS technologies," *IEEE Trans. Microwave Theory Tech.*, vol. 49, no. 12, December 2001, and W. Kim, M. F. Iskander, "High Performance Low Cost Phase Shifters Design Based on the Ferroelectric Materials Technology," *IEE Electronic Letters,* 2004, vol. 40, no. 21, pp. 1345–1347.

It is understood that many modifications and variations may be devised given the above description of the principles of the invention. It is intended that all such modifications and variations be considered as within the spirit and scope of this invention, as defined in the following claims.

The invention claimed is:

1. An improved continuous transverse stub (CTS) antenna comprising:

(a) a planar substrate base made of material of a low dielectric constant;

(b) a pair of coplanar waveguide (CPW) feed elements spaced apart by a given distance aligned in parallel with each other and mounted perpendicularly on a ground plane surface of the substrate base, wherein said CPW feed elements form a parallel feed transmission line through a coplanar waveguide interface; and (c) a continuous transverse stub disposed on the ground plane surface of the substrate base extending in a transverse direction perpendicularly through a clearance gap formed through the CPW feed elements, wherein said transverse stub acts as a reactive, radiating member in conjunction with the feed transmission line of the coplanar waveguide interface for operation as a traveling-wave-fed antenna.

2. An improved continuous transverse stub (CTS) antenna according to claim 1, wherein the CPW feed elements have a first height (H1) above the ground plane surface and a first width (W1) across the ground plane surface, a gap height (H2) of the clearance gap above the ground plane surface, a second width (W2) of opposite outward portions on the ground plane surface on each outward side of the CPW feed elements, a first length (L1) between the parallel CPW feed elements, and a second length (L2) of opposite outward portions on the ground plane surface on each outward side of the CPW feed elements.

3. An improved continuous transverse stub (CTS) antenna according to claim 2, wherein the clearance gap height (H2) is used to adjust a coupling capacitance to compensate for inductance of the reactive transverse stub.

4. An improved continuous transverse stub (CTS) antenna according to claim 2, wherein the second length (L2) of the outward portions from the CPW feed elements is selected to maintain a good impedance match.

5. An improved continuous transverse stub (CTS) antenna according to claim 2, wherein the preferred first length (L1), first width (W1), and first height (H1) are selected to be approximately a half wavelength, one wavelength, and one third wavelength of a traveling wave sent on the feed transmission line.

6. An improved continuous transverse stub (CTS) antenna according to claim 2, wherein the CPW feed elements are a pair of rectangular plates in parallel having the first length (L1) between them and each having the first width (W1) and first height (H1).

7. An improved continuous transverse stub (CTS) antenna according to claim 2, wherein the CPW feed elements are a pair of semi-circular plates in parallel having the first length (L1) between them and each having the first width (W1) and first height (H1) at its apex.

8. An improved continuous transverse stub (CTS) antenna according to claim 2, wherein the width (W2) of the opposite outward portions on each side of the first width (W1) of the CPW feed elements is preferably one third wavelength of a traveling wave sent on the feed transmission line to reduce undesired back lobes.

9. An improved continuous transverse stub (CTS) antenna according to claim 1, wherein the transverse stub is formed by a central portion of width (CW1) made of a conductive coating extending longitudinally in the transverse direction on the ground plane surface through the clearance gap formed through the CPW feed elements, and a pair of stub gaps of width (CW) on each side of the central portion separating it from opposite outward portions on the ground plane surface on each outward side of the pair of gaps.

10. An improved continuous transverse stub (CTS) antenna according to claim 9, wherein the central portion width (CW1), signal conductor width (CW) of the pair of stub gaps, total stub gap width (GW), and dielectric constant ($\in_r$) of the stub material are chosen to provide 50 ohm feed impedance.

11. An improved continuous transverse stub (CTS) antenna according to claim 1, wherein the CPW feed elements have a first height (H1) above the ground plane surface and a first width (W1) across the ground plane surface, a gap height (H2) of the clearance gap above the ground plane surface, a second width (W2) of opposite outward portions on the ground plane surface on each outward side of the CPW feed elements, a first length (L1) between the parallel CPW feed elements, a second length (L2) of opposite outward portions on the ground plane surface on each outward side of the CPW feed elements, and wherein the transverse stub is formed by a central portion of width (CW1) made of a conductive coating extending longitudinally in the transverse direction on the ground plane surface through the clearance gap formed through the CPW feed elements, and a pair of stub gaps of width (CW) on each side of the central portion separating it from opposite outward portions on the ground plane surface for a total stub gap width (GW), said antenna being designed for operating at 5.3 GHz and having the following approximate values selected to provide for low input impedance, high radiated power, and a broadside radiation pattern:

H1=18.2 mm
H2=1.5 mm
W1=54.5 mm
W2=28.3 mm
L1=27.3 mm
L2=54.5 mm
CW=CW1=4.7 mm
GW=5.97 mm
Dielectric constant ($\in_r$)=2.94 (RT/Duroid 6002)
SH=3.01 mm.

12. An improved continuous transverse stub (CTS) antenna according to claim 1, formed as a coplanar waveguide continuous transverse stub array.

13. An improved continuous transverse stub (CTS) antenna according to claim 1, formed as a multiband coplanar waveguide continuous transverse stub antenna.

14. An improved continuous transverse stub (CTS) antenna according to claim 1, formed as a CPW-CTS array with beam steering capabilities.

* * * * *